US006123610A

United States Patent [19]

Larsen

[11] Patent Number: 6,123,610

[45] Date of Patent: Sep. 26, 2000

[54] POLISHER FOR SPHERICAL AND NON-SPHERICAL SURFACES

[76] Inventor: Eric A. Larsen, 1117 NW. 52nd St., Seattle, Wash. 98107

[21] Appl. No.: 09/271,234

[22] Filed: Mar. 17, 1999

[51] Int. Cl.[7] ..... B24B 29/00

[52] U.S. Cl. ..... 451/285; 451/42

[58] Field of Search ..... 451/390, 285, 451/60, 42, 255, 256, 277, 242, 246, 384, 385, 398

[56] References Cited

U.S. PATENT DOCUMENTS

| | | | |
|---|---|---|---|
| 1,975,854 | 10/1934 | Mashall | 451/255 |
| 4,409,760 | 10/1983 | Nagaura | 51/284 R |
| 4,598,502 | 7/1986 | Lombard | 451/42 |
| 4,979,337 | 12/1990 | Duppstadt | 51/209 |

*Primary Examiner*—Rodney A. Butler
*Attorney, Agent, or Firm*—Delbert J. Barnard

[57] ABSTRACT

A lens (L) or the like is placed in a lens holder (16) with a concave end (CC) in contact with a resilient, semi-spherical polishing head member (98) that may or may not be covered by a polishing cloth (PC). The lens holder (16) and lens (L) are rotated in one direction. The resilient, semi-spherical polish carrying member (98) is rotated in the opposite direction. The lens holder (16) and lens (L) are swung sideways to move the surface to be polished along an arcuate path. The concave surface to be polished is in contact with the resilient, semi-spherical member (98). A surface to be polished presses against the resilient, semi-spherical surface (98), causing it to compress. This stores energy in the member (98) that urges the member (98), and any polishing compound on it, into tight contact with the surface to be polished.

11 Claims, 5 Drawing Sheets

54
32
102
10
36
16
PC
46
144
12
SPINDLE
SPEED
OSCILATION
SPEED
ON
OFF
CCW
CW
START 102
48
16
82
L
84
80
CC
PC
144
46

16
48
82
84
86
90
80

94
96
98
100
92
46

88
48
16
84
82
L
80
10
10
PC
144
46

POLISHER FOR SPHERICAL AND NON-SPHERICAL SURFACES

TECHNICAL FIELD

This invention relates to a polisher for a concave surface on a lens or other member. More particularly, it relates to such a polisher that is adapted to polish both spherical and non-spherical concave surfaces.

BACKGROUND OF THE INVENTION

U.S. Pat. No. 5,095,660, granted Mar. 17, 1992, to Laurence A. Dillon, discloses a mechanism for polishing a concave surface on a lens blank 14. A similar polisher is disclosed by U.S. Pat. No. 4,707,949, granted Nov. 24, 1987 to Lars Hellström. U.S. Pat. No. 5,024,024, granted Jun. 18, 1991 to Masaki Watanabe shows a polishing machine having a rotary lens holder 22 that holds a lens 26 in contact with a rotary polishing head.

A principal object of the present invention is to provide an improved polishing machine or polisher for a concave lens surface or the like which is adapted to polish both spherical and non-spherical concave surfaces. An object of the invention is to provide a single polishing tool which completely polishes a back lens surface from center to edge. It is an object of the present invention to provide a polisher that with the same tool will polish the following concave surfaces: spherical (5 mm to 11 mm radius); spherical multicurve; spherical with one to many peripheral curves; aspheric; aspheric with aspheric periphery; spherical with aspheric periphery; conical; reverse geometry; rotationally non-semetric; toric; and multifocal.

BRIEF SUMMARY

One aspect of the invention is to provide a resilient polishing bulb having a tubular first end portion that is adapted to be stretched radially for fitting it onto a rigid mount, and a semi-spherical opposite end portion adapted to compress when pushed upon and further adapted to resume its original shape when a force is removed from it. This polishing bulb can be used for supporting a polishing compound while the polishing bulb and a member having a surface to be polished that is in contact with the polishing bulb are being rotated.

According to another aspect of the invention, a holder is provided for a member having an end surface to be polished. The holder is basically characterized by an elongated body adapted for rotation about an axis. The body has a mounting end portion and a pair of tines connected to and extending axially from the mounting end portion. The tines have free end portions that are configured to receive and hold a member between them while in use the holder and member are rotated about the axis.

According to another aspect of the invention, a polisher is provided for polishing a concave end surface on a lens or the like. The polisher comprises a polishing head supported for rotation about a first axis. The polishing head includes a resilient, semi-spherical portion on which, in use, a polishing compound is supported. The polisher further includes a holder for a member with a concave end surface to be polished. The holder is supported for rotation about a second axis, with the concave surface of a held member positioned against the semi-spherical portion of the polishing head. The holder is further supported for simultaneous sliding movement of the concave surface of the held member relatively across the semi-spherical end portion of the polishing head.

In use, a polishing compound is positioned between the concave end surface to be polished and the semi-spherical end portion of the polishing head. Movement of the concave end surface to be polished relative to the semi-spherical end portion of the polishing head will cause the polishing compound to polish the concave end surface.

In preferred form, the polishing head includes a rigid base having a cylindrical end portion. The resilient, semi-spherical portion is an end portion of a resilient member that includes a tubular opposite end portion. The cylindrical end portion of the base is snugly received in the tubular end portion of the resilient member. Also in preferred form, a rigid sleeve fits over the tubular portion of the resilient member, for securing the resilient member to the base.

During use, the concave surface of the held member is moved against the resilient, semi-spherical end portion of the polishing head, by a force sufficient to at least slightly compress the resilient, semi-spherical end portion of the polishing head. This compression stores energy in the resilient, semi-spherical end portion of the polishing head. This energy pressure loads the polishing compound against the concave surface of the held member.

The semi-spherical end portion of the polishing head may be hollow and contain air or some other gas or fluid. A very small vent opening may be provided so that when the surface to be polished is moved against the semi-spherical end portion of the polishing head, some of the air or other gas or fluid will be expelled from the hollow interior. When the held member is moved away from contact with the semi-spherical end portion of the polishing head, the end portion will resume its initial shape, and in the process will draw air or other fluid back into its hollow interior.

According to another aspect of the invention, the holder for the member having an end surface to be polished is swung back and forth along an arcuate path, causing the concave surface to slide along the polishing compound carrying surface of the semi-spherical end portion of the polishing head. In preferred form, the mechanism for causing this movement is adjustable so that the length of the path of movement can be adjusted. Preferably also, the initial lean angle of the holder is adjustable, so as to change the end positions of the held member relative to the polishing head.

These and other advantages, objects, and features will become apparent from the following best mode description, the accompanying drawings, and the Claims, which are all incorporated herein as part of the disclosure of the invention.

BRIEF DESCRIPTION OF THE DRAWINGS

In the drawings, like reference numerals and letters refer to like parts throughout the several views, and.

BEST MODE FOR CARRYING OUT THE INVENTION

Figure 1:
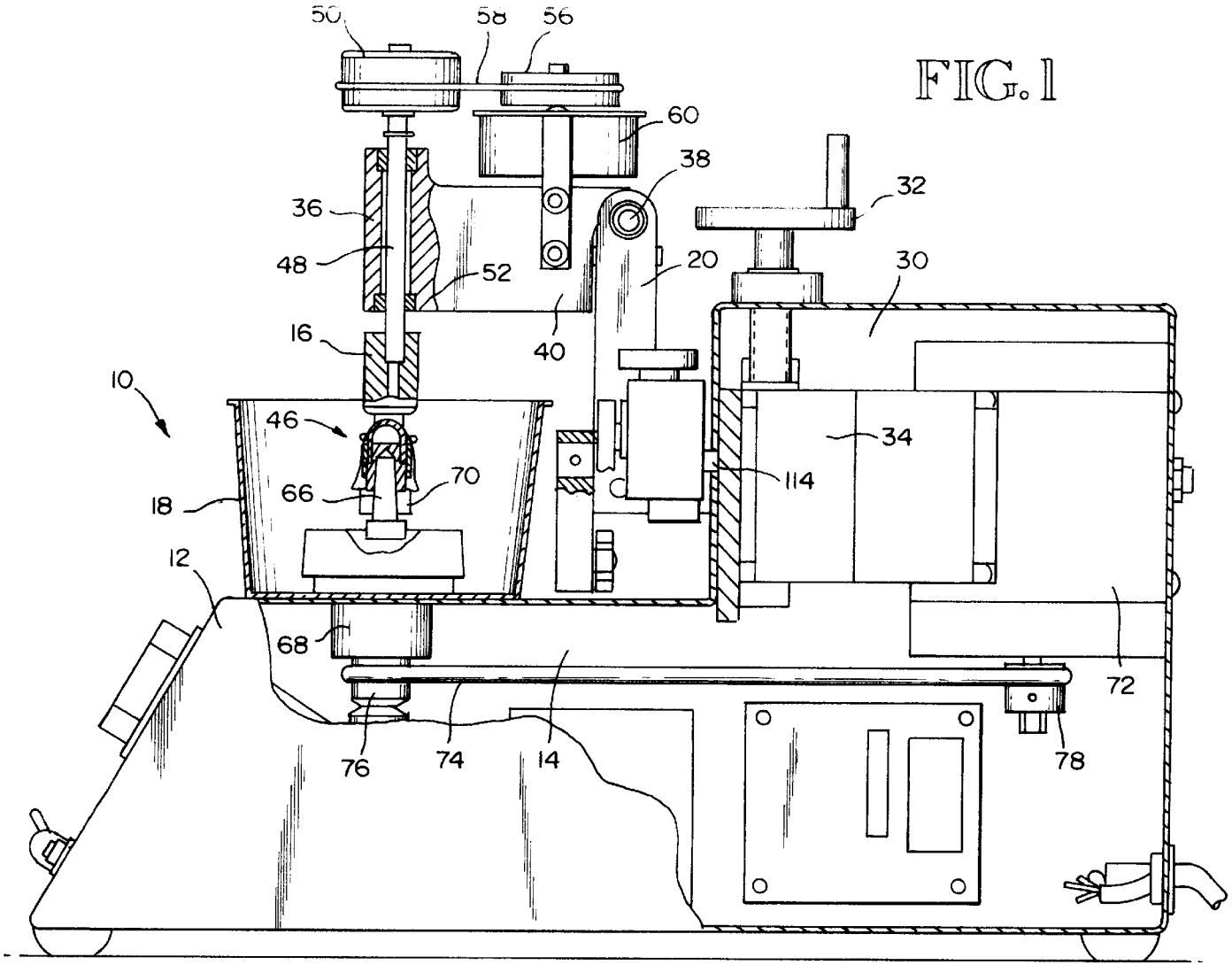
FIG. 1 is a side elevational view of a lens polishing machine, with some parts being fragmented and others being shown in section or partial section.
Figure 2:
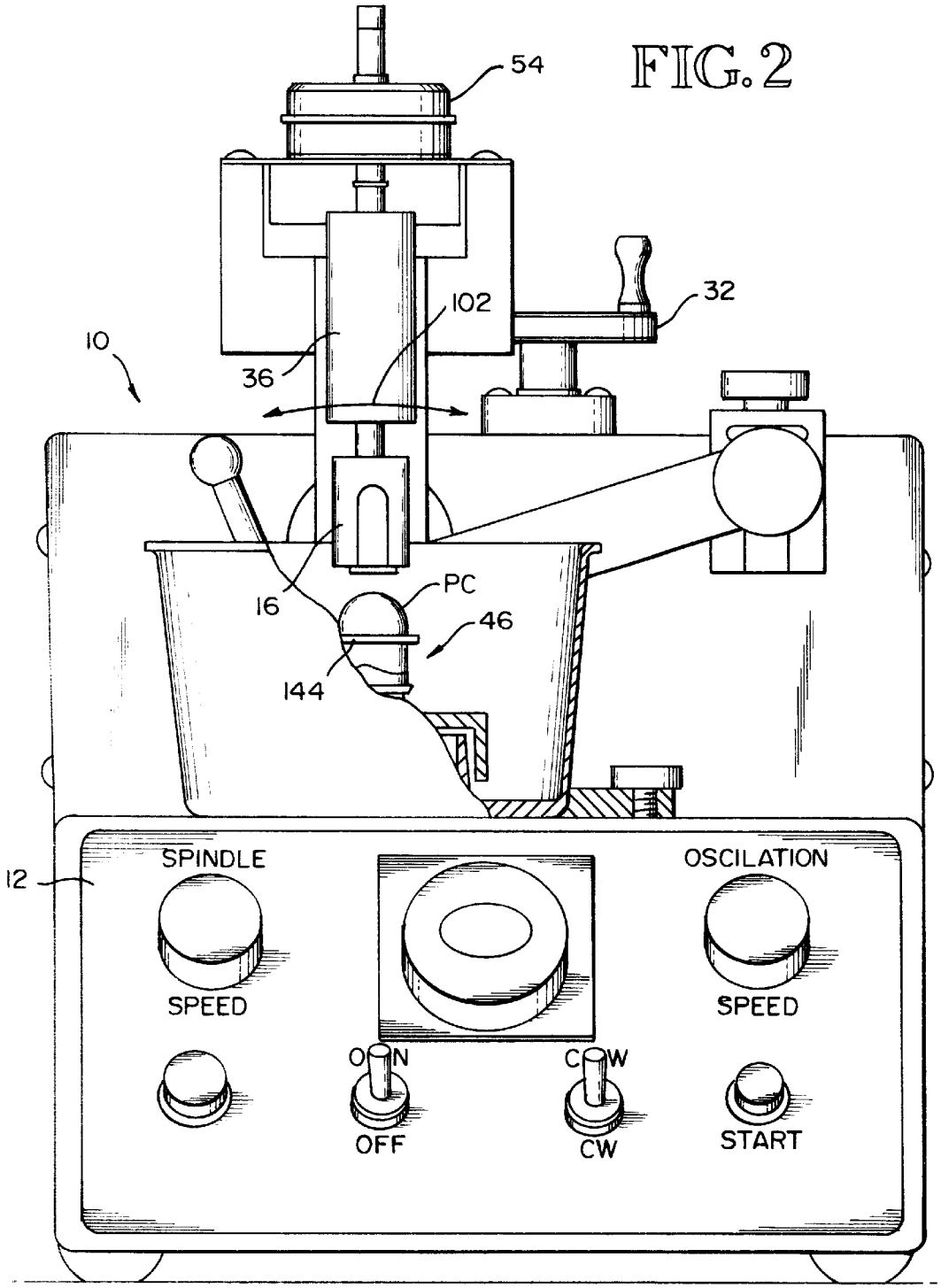
FIG. 2 is a front elevational view of the lens polishing machine of FIG. 1, showing a foreground portion of the work basin fragmented and parts in section.

FIGS. 1–12 illustrate an example embodiment of the invention which constitutes the best mode. Referring to FIGS. 1 and 2 in particular, the lens polisher 10 comprises a housing 12 forming an interior 14 in which some of the drive mechanism and control elements and circuitry are housed. Housing 12 also includes an upper forward portion where a lens holder 16 is supported. Lens holder 16 is shown in a work basin 18 that is supported on the housing 12. The lens holder assembly will now be described.

Figure 3:
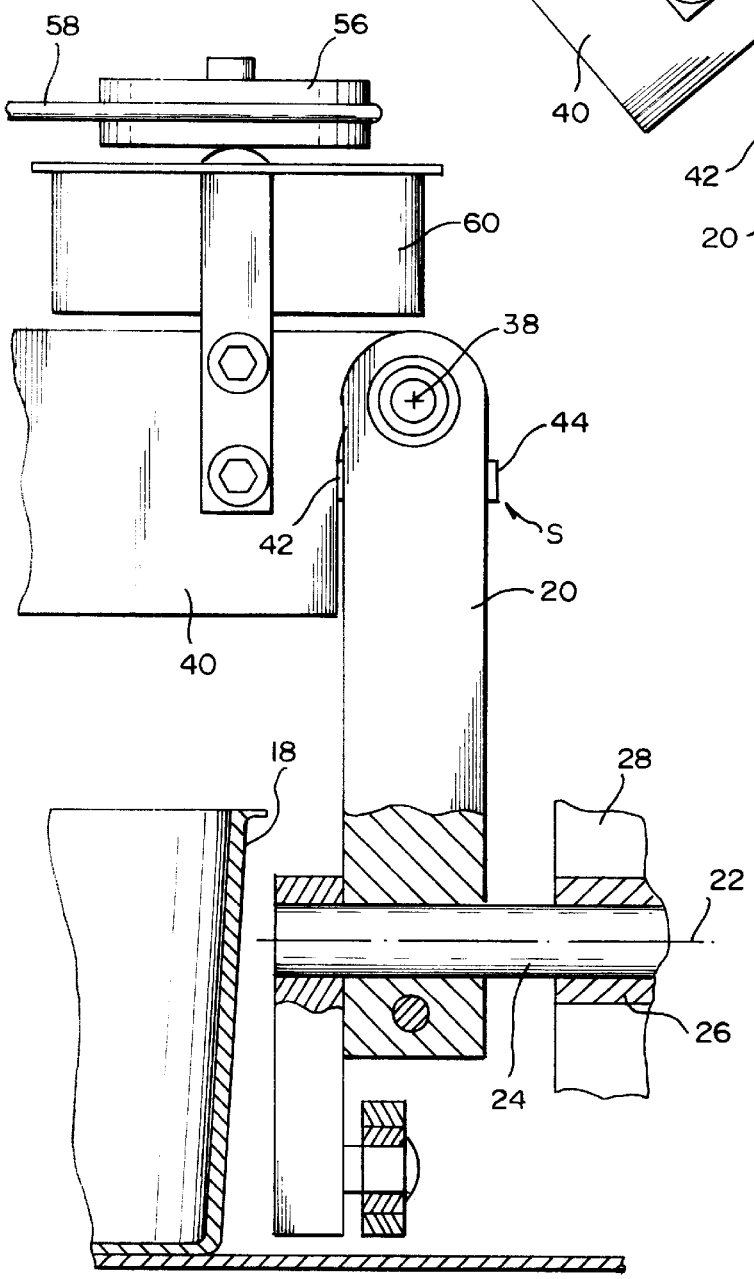
FIG. 3 is an enlarged scale fragmentary view of a portion of FIG. 1, showing portions of the structure that mounts the lens holder and portions of the drive mechanism for rotating and swinging the lens holder.
Figure 4:
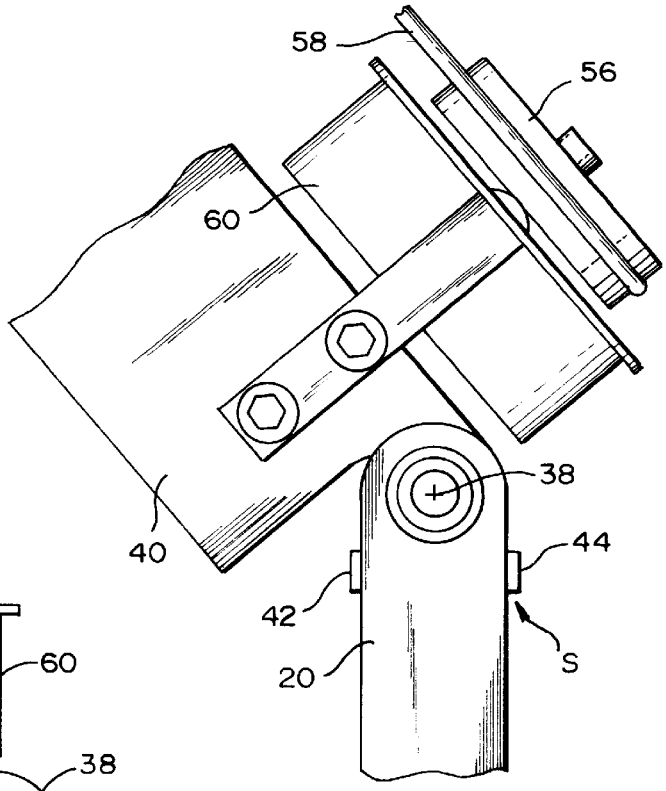
FIG. 4 is a fragmentary view of a portion of FIGS. 1 and 3, showing that the support arm for the lens holder and its drive mechanism is swingable up and down about a horizontal axis.

The lens holder assembly includes a support arm 20 that is swingable from side to side about an axis 22. Arm 20 is secured to a shaft 24 in a manner that is hereinafter described. Shaft 24 is supported for rotation by a bearing 26 that is carried by a vertically moveable structure 28 that is within an upper rear portion 30 of the housing 12. A rotary handle 32 is provided at an upper end of a lead screw (not shown) that extends downwardly into housing portion 30 and engages a nut that is within a member 34. Rotation of handle 32 in one direction will cause the lead screw to rotate and move the nut and the structure connected to it downwardly. Rotation in the opposite direction will move the nut and the structure connected to it upwardly. This structure includes the member 28 and the shaft 24. A second arm 36 is connected to arm 20 for pivotal movement about a horizontal axis 38. As best shown by FIGS. 1, 3 and 4, an upper rear portion of the arm 36 is connected to the upper portion of arm 30. A rear portion of arm 36 depends from the location of the connection down to a position forwardly of the arm 20. Gravity will tend to rotate the arm 36 and the structure carried by it into the position that is shown by FIG. 1. In this position, the arm portion 40 makes abutting contact with the forward end 42 of a set screw S. The rear end 44 of the set screw S includes a screwdriver slot, or the like, enabling the set screw S to be rotated. Rotation of set screw S adjusts the distance of set screw end 42 away from arm 20. As can be seen, this will adjust the position of the arm 36 relative to the axis 38. By use of set screw S, the tool holder 16 can be moved between a position in which its axis of rotation is substantially vertical and a position in which its axis of rotation leans away from vertical.

As best shown by FIG. 4, the support arm 36 and the structure that it carries can be swung upwardly and rearwardly to move the lens holder 16 out from the work basin 18 and away from the polishing head 46. Thus, the support arm 36 and the lens holder 16 are movable vertically along an arcuate path, between a position in which the axis of rotation of the lens holder 16 is vertical, or at some angle, leaning from vertical as determined by the setting of set screw S, and a position in which the axis of rotation of the lens holder 16 is horizontal or closer to being horizontal than to being vertical. This allows the lens holder assembly to be swung up out of the way when it is desired to install or remove a polishing cloth, or doing some servicing of the polishing head 46 within the work basin 18, etc.

As best shown by FIG. 1, the lens holder 16 is connected to the lower end of an upper spindle or shaft 48. Spindle 48 is supported by bearings 50, 52 that are housed within the arm 36. The upper end of spindle 48 is connected to a pulley 54. Pulley 54 is spaced from a second pulley 56. Pulleys 54, 56 are interconnected by drive belt 58. Pulley 56 is connected to the output shaft of an electric motor 60 that is secured to and carried by the arm 36. Rotation of the output shaft of motor 60 will cause rotation of pulley 56. This will move belt 58 to cause rotation of pulley 54. Rotation of pulley 54 will cause rotation of the spindle 48 and the lens holder 16 connected to the spindle 48.

A second spindle 66 is supported for rotation by a bearing assembly 68 that is within a forward lower portion of the housing 12 (FIG. 1). The upper end of the spindle 66 is tapered and it receives a lower portion 70 of the polishing head 46. A drive motor 72 for the spindle 66 may be located in a rear portion of the housing 12. In FIG. 1, a drive belt 74 is shown extending between a pulley 76 at the lower end of the spindle 66 and a pulley 78 at the lower end of motor 72. Rotation of motor 72 rotates the pulley 78. Rotation of pulley 78 moves the drive belt 74 to rotate the pulley 76. As pulley 76 rotates, it rotates the spindle 66 and the polishing head 46 connected to it.

Figures 9, 10, 11, 12:
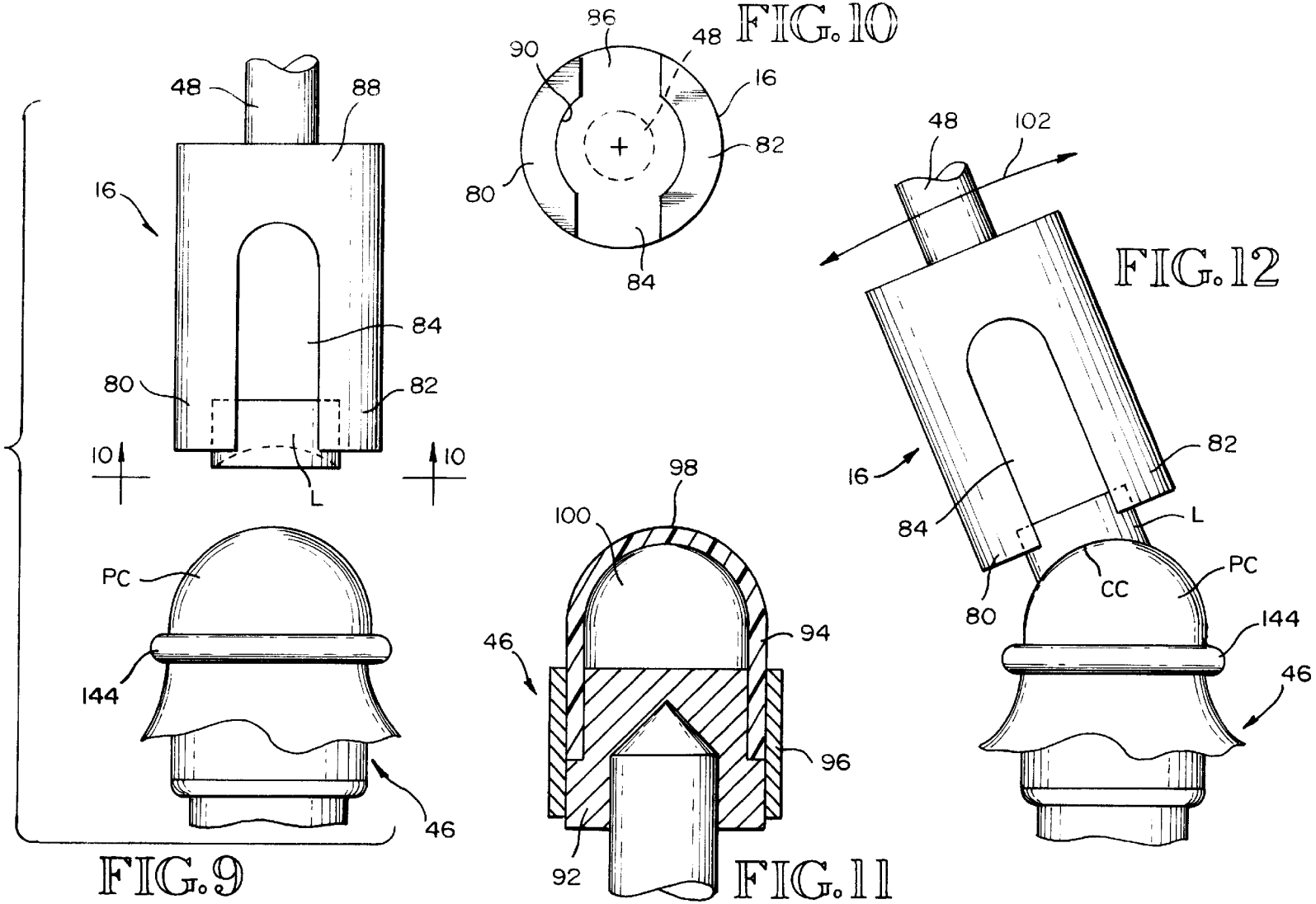
FIG. 9 is a fragmentary view showing the lens holder and a lens to be polished in a spaced relationship to the polishing head.
FIG. 10 is a sectional view taken substantially along line 10—10, looking upwardly towards the lens holder and omitting the lens.
FIG. 11 is a longitudinal sectional view taken through the polish cloth holder, with the polish cloth removed, such view showing an elastomeric member and clamp structure for clamping it to a top portion of the spindle.
FIG. 12 is a view like FIG. 9, but showing the lens holder moved to place the lens into contact with the polish cloth and its support, and showing the lens holder in the process of swinging sideways along an arcuate path.

As best shown by FIGS. 9, 10 and 12, the lens holder 16 has a somewhat tubular shape but is longitudinally slotted to define a pair of lens gripping tines 80, 82. Longitudinal slots 84, 86 are formed on diametrically opposite sides of the lens holder 16. The upper end portion 88 of the lens holder 16 is solid, i.e. nonslotted. It is connected to spindle 48. The slots 84, 86 make the tines 80, 82 resilient enough that they can well be spread apart slightly when a lens L is forced endwise into the space between them. The opening 90 in the lens holder 16 is sized to be of a diameter that is slightly smaller than the outside diameter of the lens L. In other words, there is a tight or interference fit between the lens L and the opening 90. As previously stated, the tines 80, 82 are able to spread apart to make the opening 90 larger in response to a lens L being force fitted into the opening 90. Once the lens L is within the opening 90, it is gripped by the tines 80, 82 and held firmly relative to the spindle 48.

As best shown by FIG. 11, the polishing head 46 includes a rigid base or body 92 that has a lower portion of a first outside diameter and a upper cylindrical portion with a smaller second outside diameter. A cup shaped member 94 end has a tubular end portion that slips onto the smaller diameter upper end portion of the member 92, as pictured in FIG. 11. Then, a sleeve 96 slips over the member 94 where it is connected to the member 92. The member 94 is constructed from an elastomeric material. It is in feel and operation much like a resilient bulb that is at the end of droplet forming device that comes with a bottle of eye drop or nose drop medicine, for example. Member 94 has to be stretched somewhat to fit it on to the member 92. Movement of the sleeve 96 onto member 94 will cause member 94 to compress slightly where contacted by the sleeve 96. Thus, the resiliency of the member 94 serves to firmly connect it to member 92 and to firmly connect the sleeve 96 to the assembly of member 92 and member 94.

The upper portion 98 of member 94 is substantially semi-spherical in shape. It provides the polishing head 46 with a resilient dome shaped top. The hollow interior 100 of the dome 98 contains air. It may be connected to the atmosphere such that movement of the dome wall will either expel air from chamber 100 or pull air into chamber 100. As will hereinafter be explained, in more detail, the resilient nature of the member 92, and the capture of air or gas within chamber 100, allows the dome 98 to conform in shape to the shape of a lens surface that is being polished, while retaining a firm form, so that the polish is held in to contact with the surface.

Figure 5:
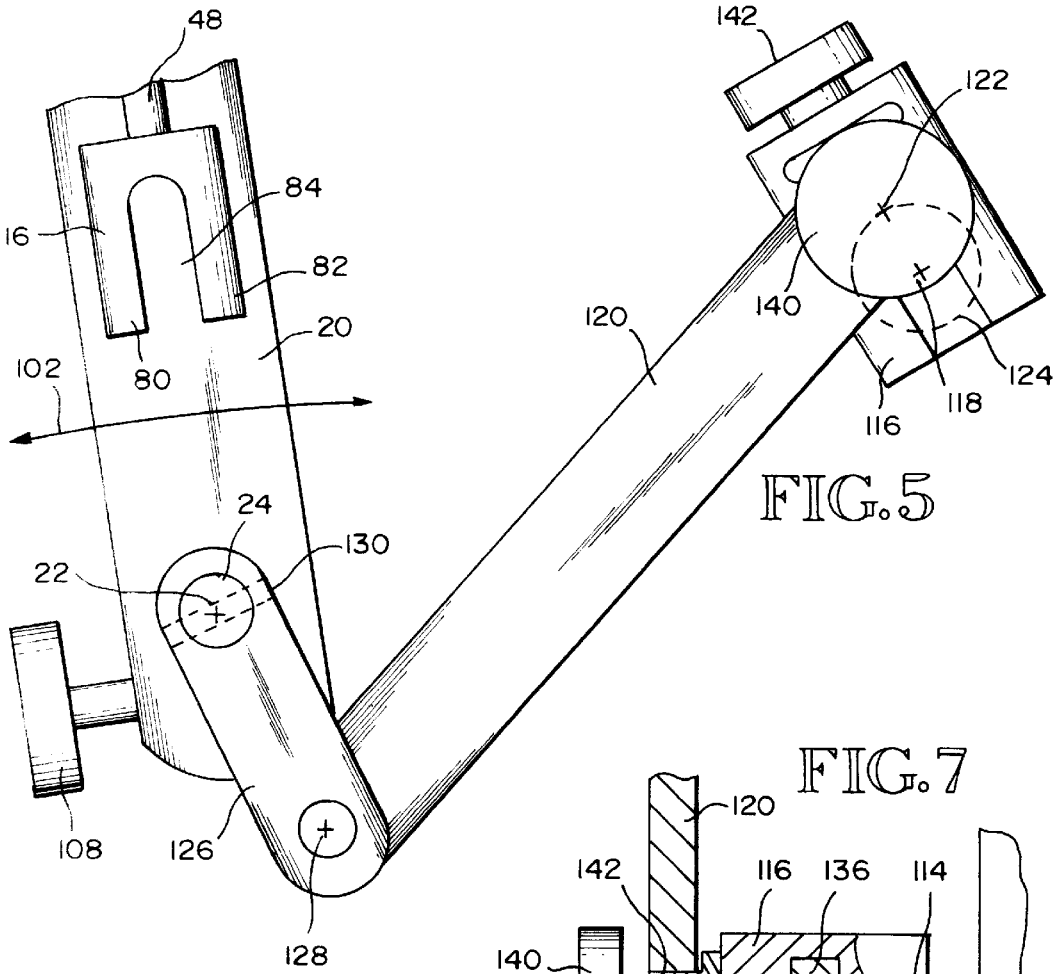
FIG. 5 is a fragmentary view of the mechanism that oscillates the lens holder and its support.
Figure 7:
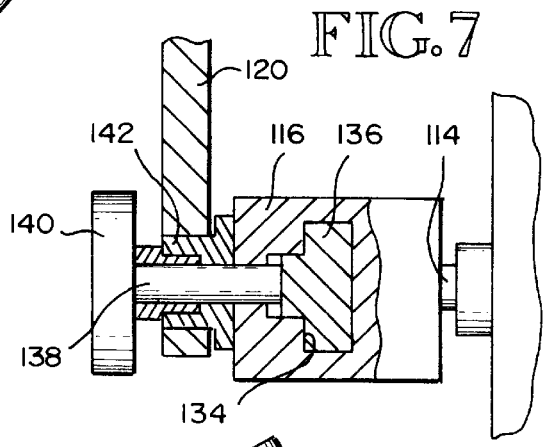
FIG. 7 is a fragmentary view partially in plan and partially in section, the section being taken substantially along lines 7—7 of FIG. 8.
Figure 6:
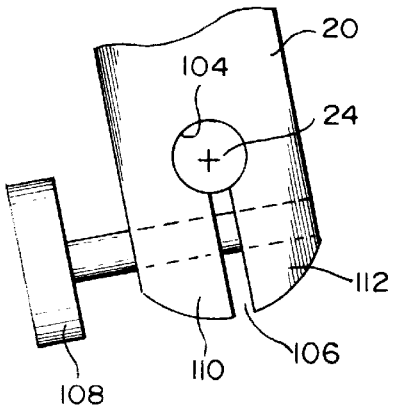
FIG. 6 is a view of a lower portion of FIG. 5 with the crank arms removed, to expose a clamp structure that clamps the support arm to the idle shaft.
Figure 8:
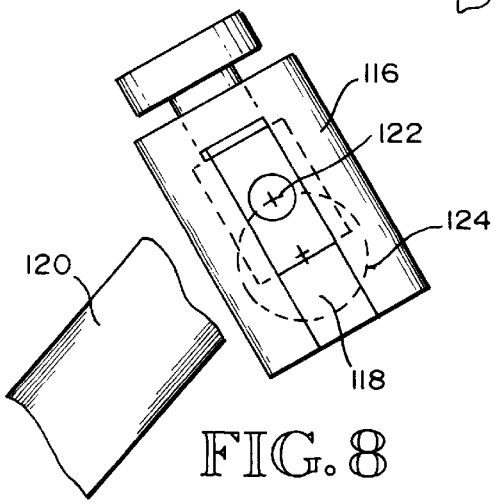
FIG. 8 is a fragmentary view that is partially in section, the section being taken substantially along line 8—8 of FIG. 7.

In a preferred form of the invention, the lens holder 16 is rotated in a first direction and the polishing head 46 is rotated in the opposite direction. This is done for the purpose of speeding up the polishing process. Referring to FIGS. 1–3 and 5, the arm 20 is at its lower end clamped onto the shaft 24. FIGS. 4–8 show a mechanism that is provided for the purpose of swinging the lens holder 16 along an arcuate path 101 while the lens holder 16 and the polishing head 46 are being rotated. As shown by FIG. 6, the lower end portion of arm 20 may include a circular opening 104 in which the shaft 24 is received. The portion of arm 20 below shaft 24 may be slotted at 126. A clamp screw 108 is shown to extend through end member 110 and to thread into a threaded opening in end member 112. Rotation of the clamp screw 108 in the clockwise direction will pull end portions 110, 112 together, and firmly clamp the surfaces of opening 104 onto the adjoining outer surface of shaft 24. This fixes the arm 20 in position relative to the shaft 24.

A rotary drive shaft 114 extends forwardly from an electric motor that is within the upper rear portion 30 of the housing 12. It is connected to a rotating arm 116, for rotation about an axis 118. The upper end of a second drive arm 120 is pivotally attached to the rotating arm 116 for movement about an axis 122. Rotation of arm 116 about axis 118 will cause axis 122 to orbit around axis 118 along a path or orbit 124. The opposite end of arm 120 is pivotally attached to the lower end of a third arm 126, for relative movement about an axis 128. The upper or opposite end of drive arm 126 is firmly connected to shaft 24 by a lock pin 130 or any other suitable locking device. As should be apparent, the arms 116, 120, 126 form a crank mechanism that serves to swing arm 20 back and forth along arcuate path 102 in response to rotation of arm 116 about axis 118. The clamp mechanism 106, 108, 110, 112, provides a first manner of adjusting the swing path 102. It provides a way of adjusting the position of arm 20 relative to any given position of shaft 24. Referring to FIG. 5, for example, in this figure the arm 20 is shown in a first position. Rotation of clamp screw 108 to loosen the clamp, followed by rotation of arm 20 relative to shaft 24 and arms 116, 120, 126, will change the path of travel of the lens holder 16 towards one end or the other of the arcuate path 102.

In a preferred embodiment, the arm 116 is also made to be adjustable in position for changing the distance that the axis 124 is from the axis 118. This is done quite simply. Arm 116 is formed to include a T-slot 134. A block 136 that is T-shaped in cross section (FIG. 7) is located within the slot 134. A shaft 138 extends from a knob 140 through a bearing 142 in arm 120 and that its inner end is connected to the block 136. Rotation of knob 140 will lock the block 136 in position relative to the arm 116. Thus, knob 140 can be rotated to free block 136 for movement. Then, block 146 can be moved lengthwise of arm 116, in one direction or the other, for changing the distance between axis 118 and axis 122. Then, the knob 140 can be rotated to firmly anchor the block 136 in position relative to the arm 116. An adjustment screw having a knob 142 may be provided for moving the block 136 in position within the T-slot 134. Firstly, knob 140 is loosened to free the block 136 for movement within the T-slot 134. Then the knob 142 is rotated to cause the movement. Knob 142 is connected to a lead screw that is connected to the block 136. Rotation of knob 142 rotates the lead screw and the rotating lead screw moves the block 136 lengthwise within the T-slot 134. When the block 136 is in a desired position, the knob 140 is rotated to apply clamping pressure that will arrest further movement of the block 136 within the T-slot 134.

Referring to FIG. 5, rotation of the arm 116 about axis 118 will cause the axis 124 to orbit about axis 118 along path 124. The orbiting movement of axis 122 imparts and push/pull motion to arm 120 which in turn imparts a push/pull motion to the lower end of arm 126. This causes a rocking motion of the shaft 24 about axis 22. Since arm 20 is secured to shaft 24, it is also rocked in position about axis 22. It is moved back and forth along arcuate path 102.

FIGS. 9 and 12 show a polishing cloth PC that has been draped over the resilient member 98 and secured to it by an O-ring 144. A small square of the polishing cloth PC is merely draped over the resilient dome 98. Then, an elastomeric O-ring 144 is inserted over the cloth PC and moved downwardly to where it is radially outwardly of the metal ring 96. In this position, the O-ring 144 is stretched. This stores energy in it that serves to bind the polishing cloth PC to the polishing head 46. It may also be possible to eliminate the polishing cloth PC and apply a polishing compound directly to the dome 98.

A polishing compound is applied to the polishing cloth PC, if it is used, or directly to the dome 98, if the polishing cloth is not used. Then, the lens holder assembly is moved for the purpose of moving the lens L into contact with the polishing head 46. The lower end of the lens L is of concave curvature CC. Let it be assumed that the outside curvature of the dome 98 is substantially spherical in nature while the concave curvature CC at the end of lens L is other than spherical. The dome 98 will change its shape in order to conform the polish carrying surface to the concave surface CC while exerting a pressure against the surface CC that will allow the polishing compound to do its work. The lens L is rotated about the axis of its spindle 48 and at the same time is swung along the arc 102. Thus, lens surface CC is rotating and sliding over the surface that holds the polishing compound. The surface that holds the polishing compound is itself rotating, preferably in a direction opposite to the rotation of the lens L. As the lens surface CC moves along the polishing compound carrying surface, it exerts a pressure on the dome 98, causing the surface of dome 98 to change its shape. Dome 98 quite easily changes it shape but continues to exert pressure against the lens surface CC, moving the polishing compound against the surface CC.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following Claims, interpreted according to accepted doctrines of Claim interpretation, including use of the doctrine of equivalents and reversal of parts.

What is claimed is:

1. A polisher for polishing a concave end surface of a held member, comprising:

a polishing head supported for rotation about a first axis and including a resilient, semi-spherical portion on which, in use, a polishing compound is supported;

a holder for a member with a concave end surface to be polished;

a support arm supporting said holder for rotation about a second axis, said holder depending from said support arm;

a mounting arm for the support arm depending from the support arm and its lower end being mounted for pivotal movement about a third axis;

said support arm supporting said holder for rotation about said axis, with the concave surface of a held member positioned against the semi-spherical portion of the polishing head; and said mounting arm supporting said support arm and said holder for simultaneous sliding movement of the concave surface of the held member relatively across the semi-spherical portion of the polishing head;

whereby a polishing compound is selectively positioned between the concave end surface to be polished and the semi-spherical end portion of the polishing head, so that movement of the concave end surface to be polished relative to the semi-spherical end portion of the polishing head will cause the polishing compound to polish the concave end surface.

2. A polisher according to claim 1, wherein the polishing head includes a rigid base having a cylindrical end portion, and wherein said resilient, semi-spherical portion is an end portion of a resilient member that includes a tubular opposite end portion in which the cylindrical end portion of the base is snugly received.

3. A polisher according to claim 1, wherein the resilient, semi-spherical portion is hollow.

4. A polisher according to claim 1, wherein the holder comprises an elongated body mounted for rotation about said second axis, said body having a mounting end portion and a pair of tines connected to and extending axially from the mounting end portion, said tines having free end portions which are configured to receive between them and hold a member that includes a concave end surface to be polished.

5. A polisher according to claim 1, wherein the lower end of the mounting arm is secured to a rotary shaft, for rotation with the shaft about the second axis.

6. A polisher according to claim 2, wherein said polishing head includes a rigid sleeve that fits over the tubular portion of the resilient member, for securing the resilient member to the base.

7. A polisher according to claim 3, wherein the holder is configured to position the concave surface of a held member to move against the resilient, semi-spherical portion of the polishing head with a force sufficient to at least slightly compress the resilient, semi-spherical portion of the polishing head, so as to store energy in the resilient, semi-spherical portion of the polishing head for pressure loading polishing compound against the concave surface of the held member.

8. A polisher according to claim 5, wherein the lower end of the mounting arm is adjustably secured to the rotary shaft, so that its angular position on the shaft can be changed.

9. A polisher according to claim 5, comprising a crank arm connected to the mounting arm and movable for swinging the mounting arm, the support arm and the holder sideways along an arcuate path centered at the second axis.

10. A polisher according to claim 9, comprising a drive arm mounted for rotation about a fourth axis that is parallel to the third axis, and a connecting arm pivotally attached at one end to the drive arm for rotation about a fifth axis that is offset from the fourth axis, and pivotally connected at its opposite end to the crank arm for rotation about a sixth axis that is offset from the third axis, whereby rotation of the drive arm moves the connecting arm and the crank arm to swing the mounting arm and the support arm and the holder connected to it, for back and forth movement of the holder along an arcuate path.

11. A polisher according to claim 10, wherein the connection of the first end of the connecting arm to the drive arm is adjustable in position towards and away from the fourth axis.

* * * * *

UNITED STATES PATENT AND TRADEMARK OFFICE

CERTIFICATE OF CORRECTION

PATENT NO: 6,123,610

DATED: Sep. 26, 2000

INVENTOR(S): Erik A. Larsen

It is certified that error appears in the above-identified patent and that said Letters Patent are hereby corrected as shown below:

On the cover under "[76] Inventor", "Eric" should be -- Erik --.

Column 2, line 46, "Claims" should be -- claims --.

Column 4, line 58, "upper cylindrical " should be -- cylindrical upper end --.

Column 4, line 60, delete " end ".

Claim 1, column 7, line 18, after "and", insert -- at --.

Claim 1, column 7, line 21, after "said", insert -- second --.

Signed and Sealed this

Eighth Day of May, 2001

*Attest:*

Nicholas P. Godici

NICHOLAS P. GODICI

*Attesting Officer*

*Acting Director of the United States Patent and Trademark Office*